US005755331A

United States Patent [19]

Watson

[11] Patent Number: 5,755,331

[45] Date of Patent: May 26, 1998

[54] PACKAGING DEVICE, PARTICULARLY FOR FRAGILE GOODS

[75] Inventor: Geoffrey Oliver Watson, Dundonald, Scotland

[73] Assignee: A. & W. Fullarton Limited, Glasgow, Scotland

[21] Appl. No.: 776,324

[22] PCT Filed: Jun. 27, 1995

[86] PCT No.: PCT/GB95/01505

§ 371 Date: Jan. 24, 1997

§ 102(e) Date: Jan. 24, 1997

[87] PCT Pub. No.: WO96/03320

PCT Pub. Date: Feb. 8, 1996

[30] Foreign Application Priority Data

Jul. 26, 1994 [GB] United Kingdom ..... 9415051

[51] Int. Cl.[6] ..... B65D 81/05

[52] U.S. Cl. ..... 206/586; 206/320

[58] Field of Search ..... 206/320, 453, 206/586, 523, 591, 594, 521

[56] References Cited

U.S. PATENT DOCUMENTS 3,701,465 10/1972 Richter .

4,287,265 9/1981 McKnight .

5,339,958 8/1994 Taravella et al. ..... 206/523

FOREIGN PATENT DOCUMENTS 29503893 5/1995 Germany .

*Primary Examiner*—Jimmy G. Foster

*Attorney, Agent, or Firm*—Lahive & Cockfield, LLP

[57] ABSTRACT

The invention is concerned with a packaging insert device adapted to prevent contact between a product and its container so as to support the product in a position in which shocks to the packaged product caused by, for example, dropping the package, are absorbed by the resilient properties of stiffly resilient lightweight plastics spacer devices received in apertures formed in end panel pieces, collars and the like formed of cardboard or other suitable insert material. A spacer device may comprise at least one protuberance projecting from a plate member and passing through a respective aperture of the plate member. Preferably multiple spacer devices comprise two or more plate members joined at a hinge line so that the plate members can be arranged, for example, into an L-shape to bridge corners and abutting edges of said end pieces or collars.

12 Claims, 5 Drawing Sheets

PACKAGING DEVICE, PARTICULARLY FOR FRAGILE GOODS

BACKGROUND OF THE INVENTION

The invention is concerned with improvements in or relating to packaging devices, particularly but not exclusively for use in the packaging of more or less fragile goods in a carton or similar box.

When products are packaged for storage and transit, it is necessary not only to restrain the products from undue movement within the carton, but also to protect them from damage by shock and vibration. The use of energy absorbing, resilient materials is therefore well established in industry and is conventionally known as cushion packaging.

Cushion packaging is intended to minimise the damaging effect on the packaged product being dropped, or from vibration due, for example, to the engines of the vehicle or ship in which the cartons are transported. Drop heights likely to be encountered actually increase when the weight of the carton is reasonably light compared with cartons that require even moderately robust lifting equipment. It has been found that the shock is better absorbed if the product is allowed to move through a very small distance in the carton and therefore the strength of the energy absorbing materials must be balanced against the required degree of resilience.

The use of preformed inserts of expanded plastics bead material has been found to give good results in a wide variety of applications, but it is commonly found that larger sized inserts are used for the sake of apparent security for the product than are actually necessary under most conditions. Such over-use of plastics materials is to be avoided where possible on environmental grounds as well as those of cost and handling.

SUMMARY OF THE INVENTION

The present invention sets out, therefore, to minimise the volume of resilient packaging inserts of plastics material for use in cartons, cases, boxes or the like.

The invention provides a packaging insert device for use as an insert within a carton or the like wherein the insert is adapted to support a product within said carton out of contact with interior surfaces of walls of said carton, said device comprising a panel member having at least one aperture formed therein, and a spacer device of stiffly resilient material and provided with at least one protuberance, the or each protuberance being adapted to be received in said aperture(s) so as to project beyond the panel member.

Advantageously, there may be provided at least two of said apertures formed in the panel member, a second aperture being formed in close positional relationship to the first aperture, said spacer device having a plurality of protuberances adapted to be received in respective ones of said apertures.

Preferably, said panel member further may comprise a flange formed at least partially along one edge thereof and extending at least substantially at right angles to the panel member, said panel member having said first aperture formed in a marginal portion thereof adjacent said flange and said second aperture formed in the flange in close relationship to the first aperture.

Alternatively, said panel member may comprise two flanges, said first aperture being formed in one of said flanges and said second aperture being formed in said second flange in close relationship to the first aperture.

Conveniently, said spacer device may comprise two plate members each joined to a neighbouring plate at adjacent edges. Said plates may be mutually perpendicular, or substantially perpendicular to each other and, being joined at adjacent edges thereof, provide the spacer member with an L-shaped cross-section, outer surfaces of said plate members being provided with said protuberances which are adapted to be received in said first and second apertures respectively so as to project beyond said flanged panel member.

Preferably, said protuberances may be provided with locking or wedge surfaces arranged to prevent unintentional withdrawal from the apertures.

In some circumstances, it may be preferable to provide a single plate member having at least two protuberances, for use in bridging end portions of an elongate panel member folded end-to-end in the manner of a collar and having one of said apertures formed at each end portion thereon into which the protuberances of the plate member are received.

The invention further provides a spacer member for use in a packaging insert device as described above and comprising an initially flat plate having a centre line formed therein, a first protuberance being provided on a surface of said plate at one side of said centre line and a second protuberance being provided on the other side of said centre line. Advantageously, the construction and arrangement may be such that the plate is capable of being folded about the centre line to form said two plate members.

Advantageously, said plate member(s) may be provided on the opposite surface to that from which the protuberances extend, with a flat, slightly raised portion, intended in use to contact a packaged product, said protuberances contacting a carton containing said product. Preferably, said raised portion may have chamfered edges.

Advantageously, said panel member may be of card, cardboard or similar material. Preferably said spacer members may be moulded of expanded beads of polypropylene or other suitable plastics materials in a desired range of size and density.

There will now be described an example of a packaging device and of spacer members according to the invention. It will be understood that the description is given by way of example only and not by way of limitation.

DESCRIPTION OF ILLUSTRATED EMBODIMENT

Figure 6:
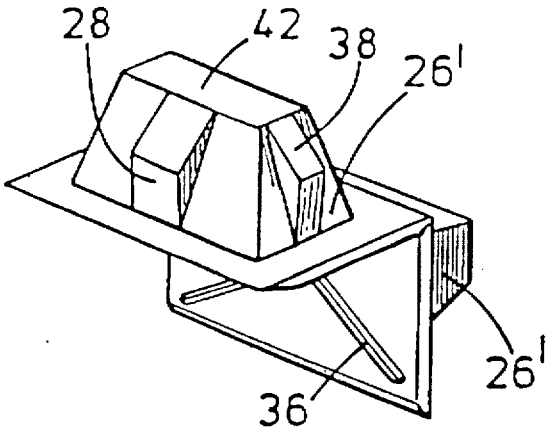
FIG. 6 shows a multiple spacer device of FIG. 4 in a folded condition.

A packaging device 2 to be described below is intended for use in association with an outer container 4 or box, conveniently of corrugated board or cardboard as shown in FIG. 6. The interior dimensions of the outer container 4 are such that the packaging device is received in a firm fit therewithin. Two such packaging devices 2 are used to enclose respective end portions of a relatively fragile product 6, which may be for example electronic equipment, say, a speaker unit. Each of the two devices 2 comprises a panel 8 having four flanges 10, 12, formed along edges thereof. The device may be formed from a cardboard blank 14 as in the present example and shown in FIG. 2.

A plurality of apertures 16 are formed in the blank, in this example, six in the panel member, two in each of the flanges 10 and one in each of the flanges 12. The flanges are foldable through an angle of 90° so as to form a tray-like configuration, by means of crease- or fold-lines 18 which provide hinge zones.

When the blank 14 has been folded along the lines 18, corners so formed between adjacent flanges 10, 12 may be fastened by any suitable means.

Figure 2:
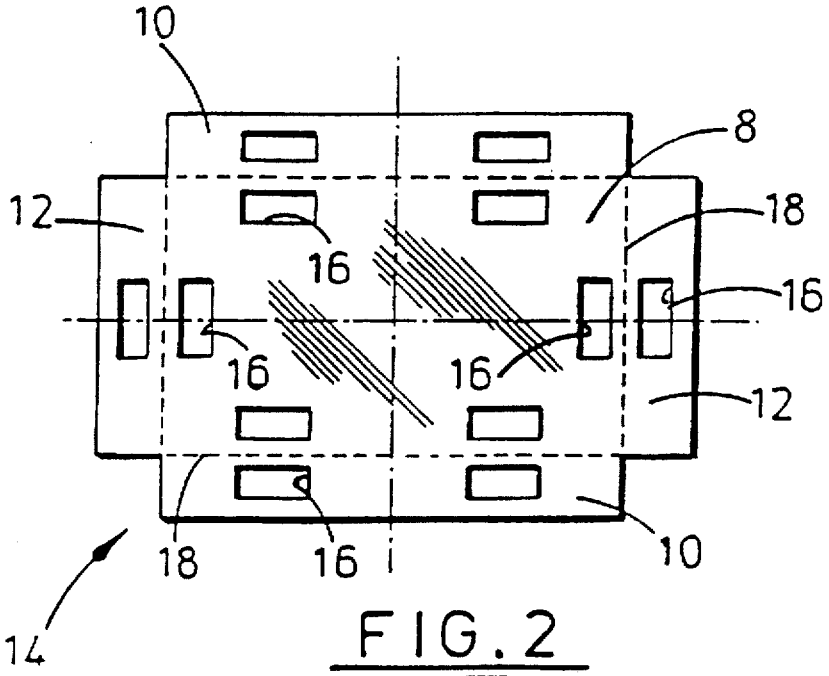
FIG. 2 is a plan view of the packaging device of FIG. 1 in an initial, flat, condition.
Figure 3:
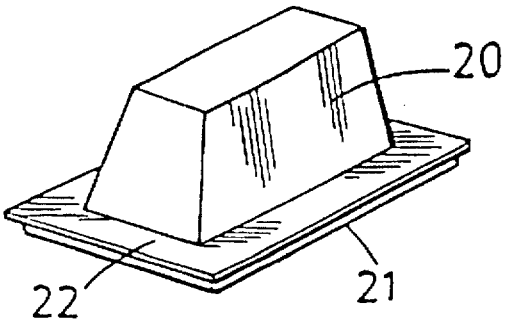
FIG. 3 is a perspective view of one of the spacer devices of FIG. 1.

FIG. 3 shows a single spacer device 20, one of which may be inserted into each of the apertures 16 shown in FIG. 2. The spacer device comprises a plate member 22 formed so as to be thickened at 21 for additional cushioning. However, a preferred arrangement is to provide a multiple device as described below.

Figure 5:
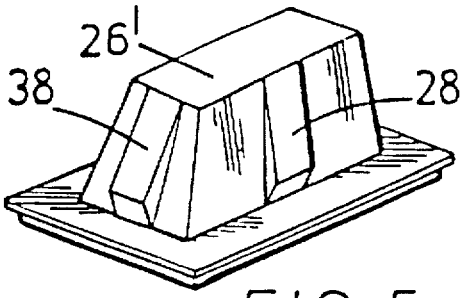
FIG. 5 shows one of a second example of spacer devices.
Figure 4:
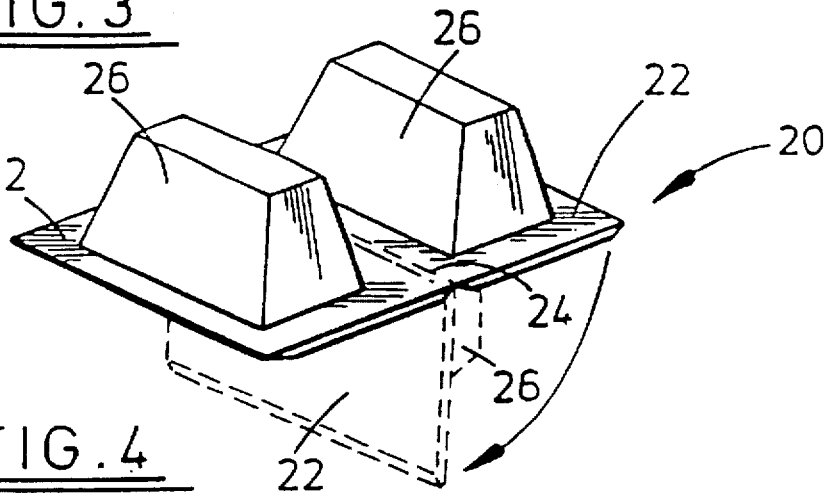
FIG. 4 shows a perspective view of a multiple spacer device according to the invention.

A multiple spacer device 20 will now be described. Two devices 20 comprising a pair of plate members 22 are joined at a hinge line 24, outwardly facing surfaces of the plate members 22 each having a projection 26 extending therefrom. The projections 26 have tapering cross sections, the base of the projections having dimensions corresponding to those of the apertures 16 in order to be a firm snap-in fit therein, as will be explained. The spacer devices of the present example are conveniently moulded from polypropylene beads and are stiffly resilient when compressive force is applied. However, to enhance the firm fit of the projections 26 in the apertures 16, wedge portions 28, 38, may be provided as shown in FIGS. 5 and 6 on outwardly facing surfaces of each pair of projections 26'. It will be understood that the devices may be dimensioned to fit precisely into a container, taking account also of the weight and fragility of the product and selecting the density (resilience) of the material from which the spacer devices are moulded. It will be noticed that the reinforcement portion 21 of FIG. 6 is provided with grooves 36, the purpose of which will be explained below.

Figure 7:
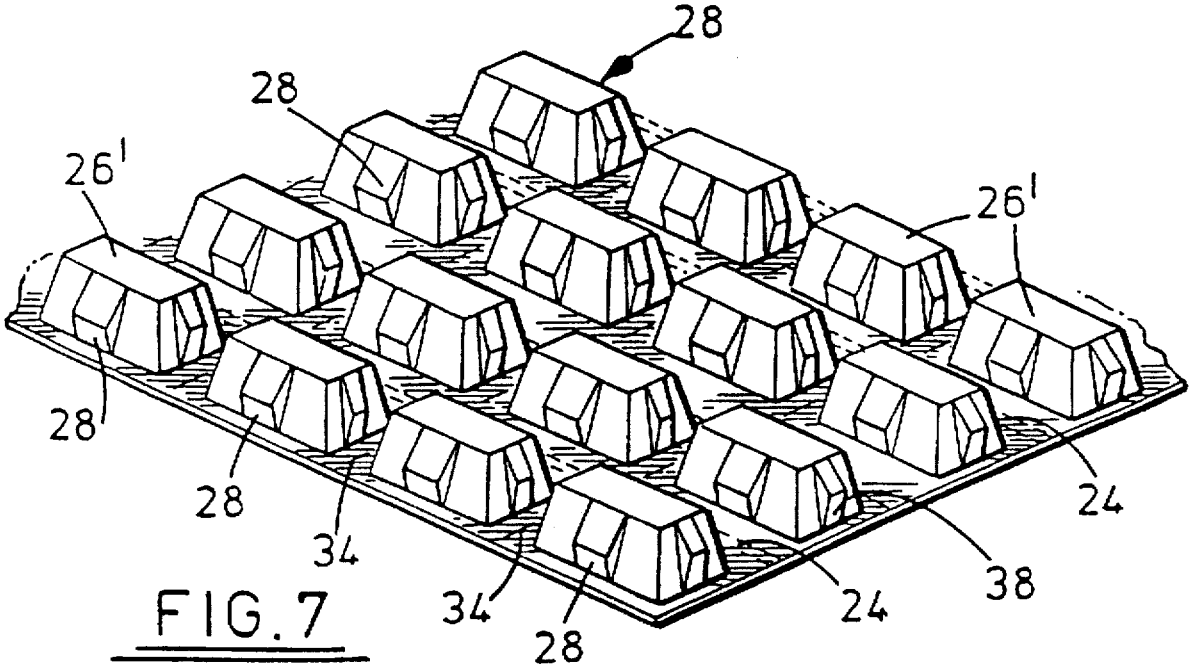
FIG. 7 shows a sheet of spacer devices as shown in FIG. 4 in an as-moulded condition.

FIG. 7 shows a sheet of spacer devices as shown in FIGS. 5 and 6, in an as-moulded condition, from which sheet spacer members may be detached in whichever configuration they may be required according to the conditions of use.

Figure 1:
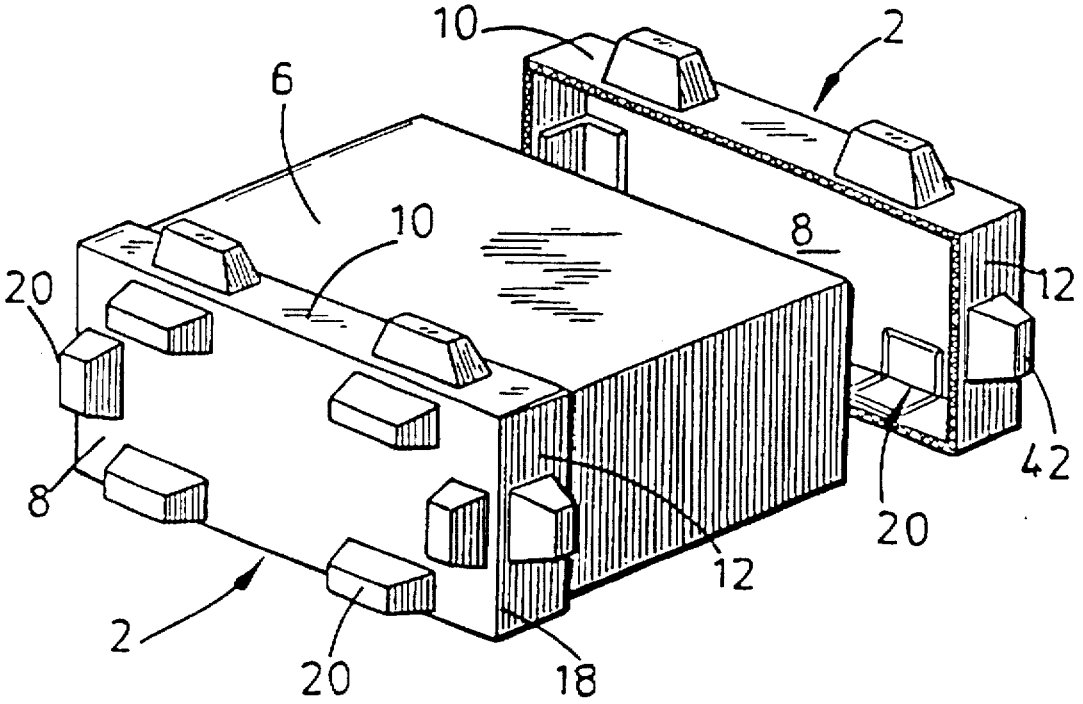
FIG. 1 is an exploded perspective view of a product received in a packaging device including a first example of spacer devices according to the invention.
Figure 8:
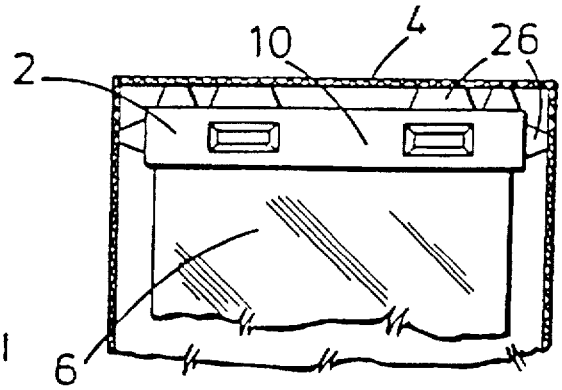
FIG. 8 shows a part sectional view of a portion of a product with a packaging device according to the invention received in a carton.

FIG. 8 shows the panel 8 of FIG. 1 in position in the container 4. It will be observed that the hinged double device 20 is suitable for use as a corner member.

Figure 9:
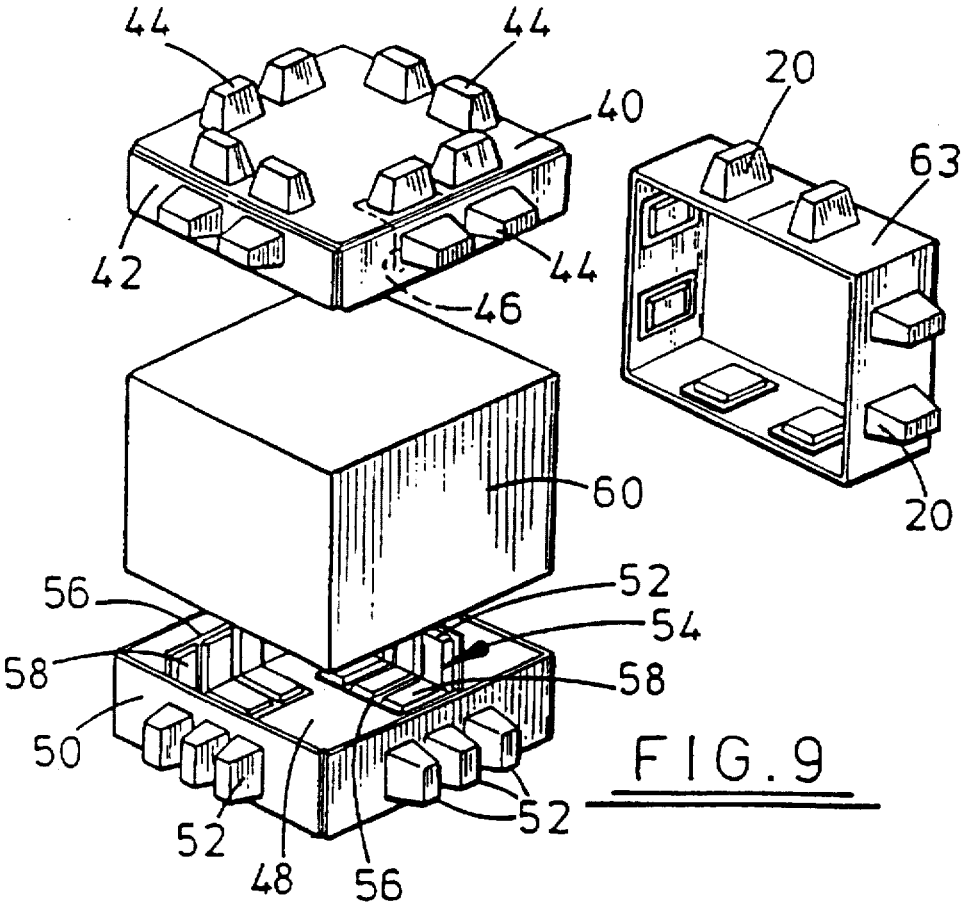
FIG. 9 shows an exploded perspective view of a product received in another packaging device including alternative arrangements of spacer devices.

FIG. 9 shows a panel 40 having flanges 42, in apertures of which are received projections 44 of eight L-shaped devices 46. As an alternative, a panel 48 is shown having flanges 50, in apertures of which are received projections 52 of four L-shaped devices 54. Each device 54 comprises two hinged plate members 56 and three of the projections 52. On interior surfaces of the plate members 56 are provided flat, slightly raised portions 58 adapted to contact a product 60, and to space it from the cardboard of the panel 48 or its flanges 50. The portions 58 which are equivalent to the reinforcing portions 21 described above have bevelled edges 62. A collar-like arrangement is also shown in which a folded panel 63 provides apertures for a plurality of single devices 20 (FIG. 3).

Figure 10:
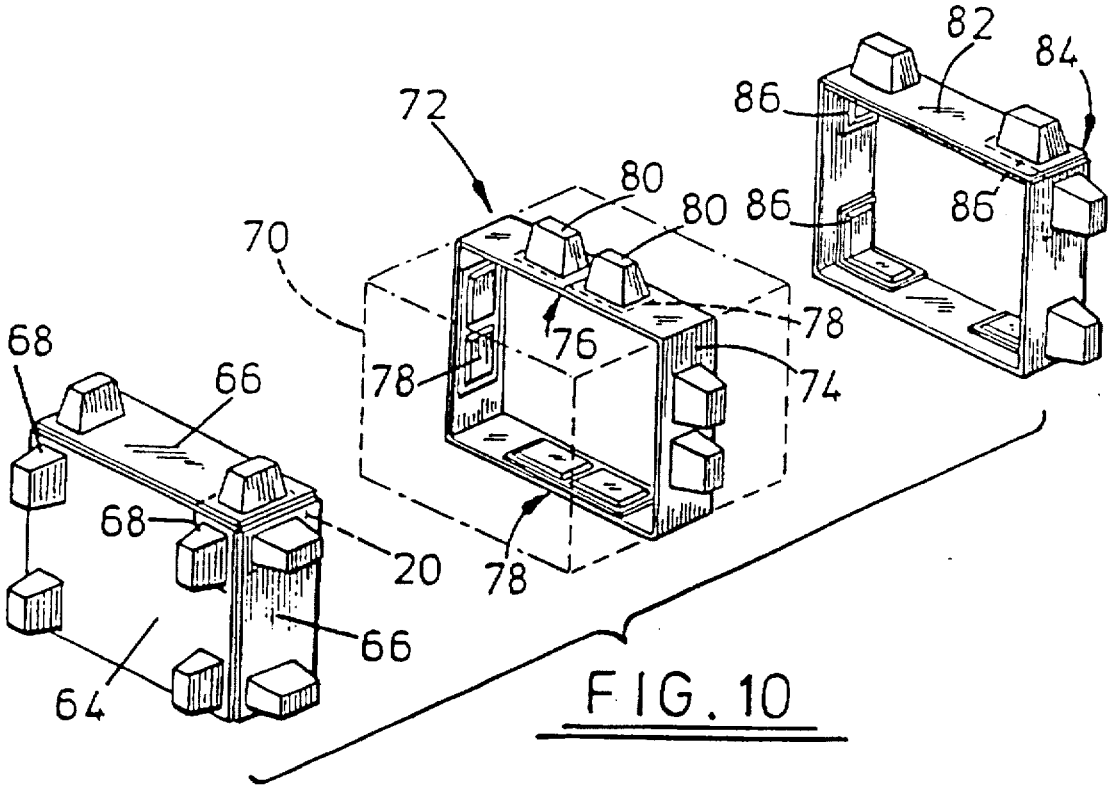
FIG. 10 illustrates an end spacer device and two alternative intermediate spacer devices or collars including further alternative arrangements of spacer devices.

FIG. 10 shows a device incorporating a number of alternative arrangements. Panels 64 are provided with flanges 66, folded to form corner regions in which abutting edges of the flanges 66 are bridged by L-shaped spacer devices 20 (as shown in FIGS. 3 or 5) with the addition of single spacer devices at 68. In the present example, the bridging action of the devices 20 assists in assembly of the packaging around the product 70.

A similar device (not shown) will be provided at the opposite end of the product 70.

However, where the length of the product between the devices according to the invention exceeds a given distance, it may be advantageous to provide intermediate support and protection in the form of a collar-like arrangement indicated at 72. This comprises a panel 74 folded so that its ends abut at 76 and are bridged by a linear device 78 comprising two projections 80 passing through respective apertures (not visible) in the folded ends. Three additional devices 78 are received in the remainder of the panel 74.

An alternative collar-like arrangement is also shown in FIG. 10, in which edges of a folded panel 82 abut at a corner 84. In this lay-out, a first L-shaped device 86 is inserted to bridge the abutting edges, three other devices 86 being provided at the remaining corners. However, corner regions of such end devices and collars may be secured together by providing additional apertured flange portions that when assembled overlap an adjacent flange portion so that apertures therein are superimposed, allowing a projection 26 to pass through both apertures in a push-fit or snap-fit, thus securing the flange portions together in an assembled condition and obviating the need for the use of securing tape.

In a further example, a corner device may be provided as shown in FIGS. 11 to 15.

Figure 11:
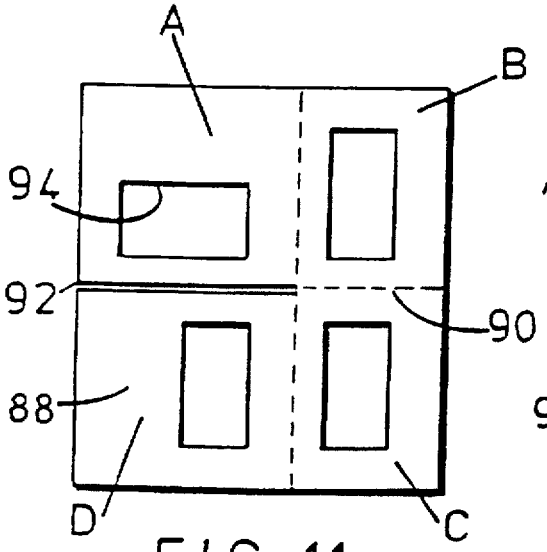
FIG. 11 shows a corner spacer device in an initial, flat, condition.
Figure 12:
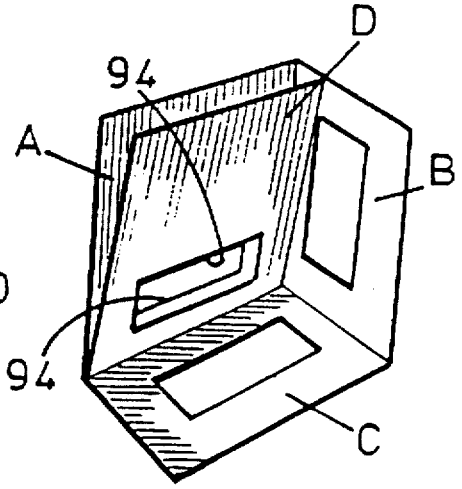
FIG. 12 shows the device of FIG. 11 in a folded condition.

FIG. 11 shows a cardboard blank 88 which comprises four panel portions A–D, formed by fold lines 90 and a slot 92. Four apertures 94 are formed in the blank which is assembled as shown in FIG. 12, with the apertures of panel portions A and D in alignment.

Figure 13:
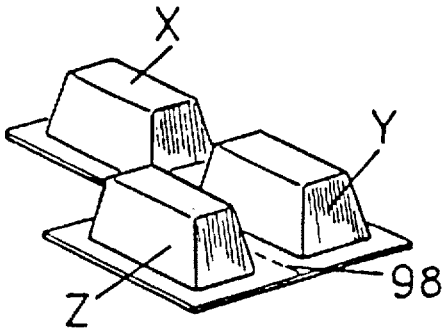
FIGS. 13 to 15 shows stages in the assembly of spacer devices in the device of FIG. 12.
Figure 15:
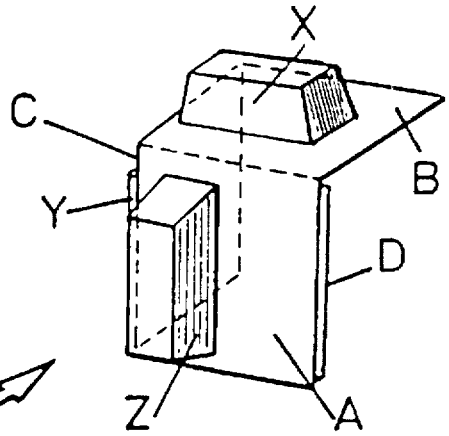
Figure 14:
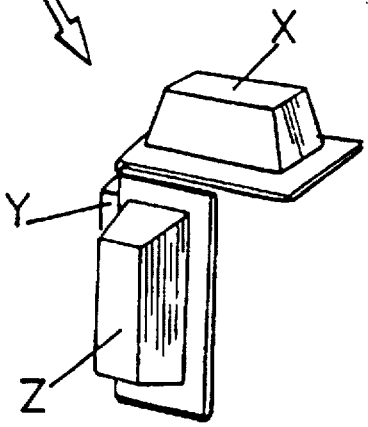

FIG. 13 shows a triple spacing device 96 having projections X, Y and Z, fold lines 98 being provided to enable the device to assume the formation shown in FIG. 14. The parts are brought together as shown in FIG. 15 so that the projection X is received in panel portion B, projection Y in panel portion C and projection Z in panel portions A and D so as to secure the latter together and maintain the desired corner-like formation.

Figure 16:
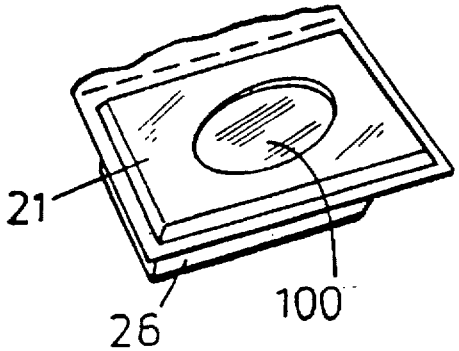
FIG. 16 shows a rear surface of a spacer device according to the invention.

In all the above examples, the projections are a push-fit, force-fit or snap-fit into the appropriate apertures according to their configuration and the characteristics of the plastics material from which they are moulded. In FIG. 16, an underside view of a spacer device shows the presence of a discontinuity in the form of a recess 100 in the thickened portion 21. Alternatively, the presence of ridges and furrows, such as the grooves 36 (FIG. 6), may provide a suitable discontinuity which permits the device more readily to flex as the projection 26 is inserted into the aperture to assist in assembly. Alternatively, a raised or relief discontinuity may be provided.

Figure 17:
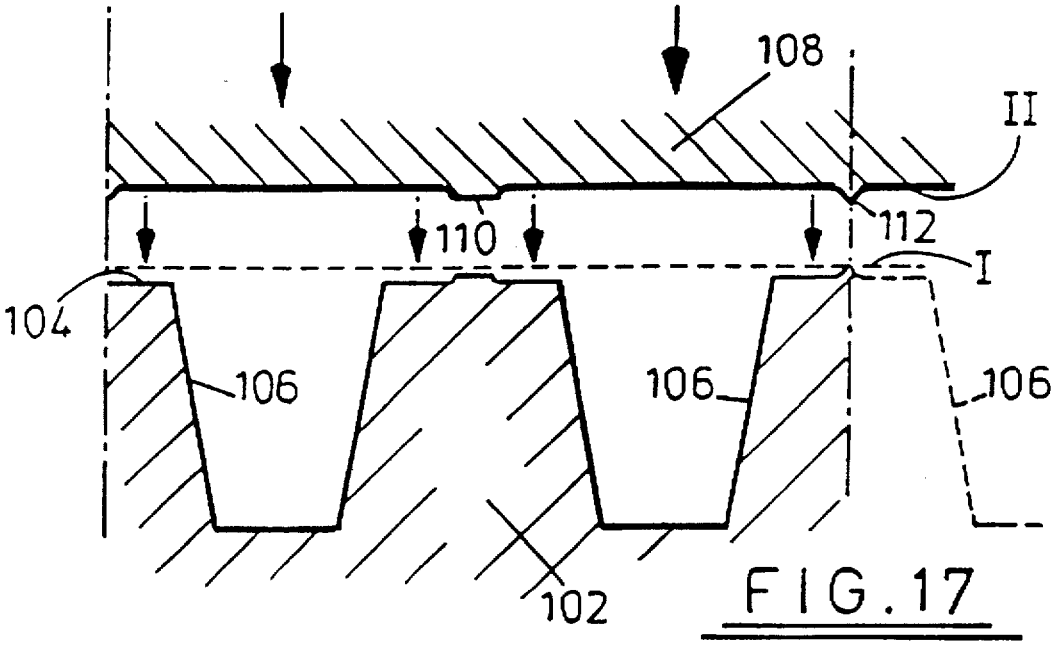
FIG. 17 illustrates a two-stage moulding technique for producing spacer devices.

In producing any of the spacing devices described above, a two-stage moulding technique may be used. The bead material is compressed in stage I into a mould member 102 (see FIG. 17) having a moulding surface 104 provided with cavities 106 corresponding to the projections. When the material is partially set, a second moulding plate 108 is brought into operation in stage II to further compress the bead material forming the plate member 22. The second moulding plate 108 is provided with a ridge 110 which forms the required hinge line 24. FIG. 7 shows a multiple moulding of a plurality of spacer devices 20, break-lines 34 permitting division of the multiple moulded product into single units. FIG. 17 also shows the extension of the mould members into the multiple mode with projections 112 provided on the moulding plate 108 to produce the break-lines 38 between the individual products.

In use of an example according to the invention, two blanks 14 will be required for a product such as electronic equipment 6 shown in FIGS. 1 and 8. The flanges 10, 12 on each blank are folded about lines 18 and the spacer devices are also folded about line 24 as shown in FIG. 5 and fitted to the tray-like device 2 so that the projections 26 (26') extend outwardly from the apertures 16, each spacer device fitting within the 90° angle formed between the flanges 10 or 12 and the panel 8 and inserted without the use of tape or adhesives. The ends of the unit 6 are then inserted into the assembled tray-like device 2 and the whole is placed within the cartons 4 so that the only contact between the unit 6 and the carton is through the projections 26 (26') which span the space between the tray-like devices 2 and the carton 4. It will be understood that the dimensions are chosen so that the unit 6 fits closely within the tray-like devices 2 and outwardly facing surfaces 42 of the projections 26 (26') are in close contact with the carton 4.

If desired, further packaging means may be used in addition to the devices 2 shown above. Conveniently, these may comprise shaped cardboard inserts. Various modifications may be made within the scope of the invention as defined in the following claims.

I claim:

1. A packaging insert device for use as an insert within a carton wherein the insert is adapted to support a product within said carton out of contact, with interior surfaces of walls of said carton, said device comprising a panel member having at least two apertures formed therein, and a spacer device of stiffly resilient material and provided with at least two protuberances, each protuberance being adapted to be received in a respective one of said apertures so as to project beyond the panel member, and wherein said spacer device comprises an initially flat plate member having a center line formed therein, at least a first of the protuberances being provided on a surface of the plate member at one side of the center line and at least a second of the protuberances being provided on the other side of said center line.

2. An insert device as claimed in claim 1, wherein said panel member comprises a first panel portion and a second panel portion formed at least partially along one edge of said first panel portion and extending at least substantially at right angles thereto, each said panel member portion having one of said apertures formed adjacent to said edge thereof.

3. An insert device as claimed in claim 2, wherein said panel member comprises a further panel portion formed at least partially along a second edge of the first panel portion and extending at least substantially at right angles to each of said first and second panel portions, said further panel portion being provided with a further one of said apertures.

4. An insert device as claimed in claim 3, wherein said panel portions are folded so as to produce a partially overlapping configuration, so that a protuberance is received in aligned congruent apertures of respective panel portions to maintain said configuration.

5. An insert device as claimed in claim 3, wherein said first panel portion comprises a main panel portion and said second and further panel portions are in the form of flanges formed at respective edges of said main panel portion.

6. An insert device as claimed in claim 3, wherein said first and further panel portions are four in number and are arranged end-to-end in a continuous band or collar.

7. An insert device according to claim 1, wherein said plate member has said protuberances projecting from one surface thereof and a raised portion provided on an opposite surface of the plate number to each protuberance, said raised areas being adapted to be in contact with said product and said protuberances being adapted to be in contact with one of said carton walls when the insert device is in use.

8. An insert device according to claim 7, wherein the protuberances of said plate members are formed with wedge portions to enhance their fit within the apertures of the panel members.

9. An insert device according to claim 1, wherein said center line comprises a hinge line or area.

10. An insert device according to claim 1, wherein the flat plate member is molded, together with said protuberance, from a stiffly resilient, lightweight plastics material.

11. An insert device according to claim 10, wherein the plastics material is selected from the group consisting of polyethylene, polyurethane and polypropylene.

12. An insert device according to claim 10, wherein the plastics material comprises molded foam.

* * * * *